US005938055A

United States Patent [19]

Philips et al.

[11] Patent Number: 5,938,055

[45] Date of Patent: Aug. 17, 1999

[54] SAFETY CAP AND CONTAINER

[76] Inventors: Terry Philips, 35830 Boyd Ct., Willoughby; Stephen Croke, 2246 S. Overlook Rd., Cleveland Hts., both of Ohio 44106

[21] Appl. No.: 08/815,538

[22] Filed: Mar. 12, 1997

[51] Int. Cl.[6] ..... B65D 55/02

[52] U.S. Cl. ..... 215/222; 215/230

[58] Field of Search ..... 215/206, 222, 215/230; 220/377

[56] References Cited

U.S. PATENT DOCUMENTS

| | | |
|---|---|---|
| 2,777,570 | 1/1957 | Mytinger . |
| 2,780,349 | 2/1957 | Tornberg . |
| 2,961,108 | 11/1960 | Johnson . |
| 3,924,772 | 12/1975 | Magnani . |
| 4,069,935 | 1/1978 | Hampel . |
| 4,436,213 | 3/1984 | Paul et al. . |
| 4,747,499 | 5/1988 | Gach et al. . |
| 4,747,500 | 5/1988 | Gach et al. . |
| 5,092,477 | 3/1992 | Johnson et al. . |
| 5,265,744 | 11/1993 | Duty et al. . |
| 5,400,915 | 3/1995 | Kennedy . |

*Primary Examiner*—Stephen K. Cronin
*Attorney, Agent, or Firm*—Kenyon & Kenyon

[57] ABSTRACT

A sealable container is disclosed in which a cap is provided having a circumferential outer skirt for engaging a container and having a circumferential resilient depending inner member spaced from and extending substantially parallel to the outer skirt. The cap is substantially light-transmissive over at least a portion of the visible spectrum, so as to permit viewing through the cap. A container is provided having a rigid side wall for engagement with the resilient inner member of the cap internally thereof. The side wall has an end fitting within the resilient inner member of said cap and spaced radially inwardly therefrom when the cap is secured to the container. The side wall is tapered. Structures are provided on the container remotely from the end of the rigid wall. Cooperative structures are provided on the cap for preventing the cap from being removed from the container without depression of the cap on the container and rotation of the cap on the container.

7 Claims, 4 Drawing Sheets

SAFETY CAP AND CONTAINER

BACKGROUND OF THE INVENTION

The present invention is directed to the field of child-resistant safety caps for sealing a container or vial, particularly of the type used for pharmaceutical prescriptions. Most safety caps include indicia to indicate the directions for removing the safety cap. Such indicia are typically printed on the cap in a lithographic process, or else molded into the top surface of the safety cap as a relief in the cap's surface profile.

It has been observed that such molded relief features create chafing and discomfort on the hands of pharmacists, who must open and close a great number of vials during the course of a work day. Lithographic printing contributes to the production costs of the cap, which can add considerably to the production of a large volume of caps. Also, printed indicia can become abraded and illegible after repeated opening.

Another problem encountered with previous vials is reverification of a prescription. Typically, the pharmacy label wraps around a large part of the vial, requiring repeated removal of the safety cap to reverify the contents of a prescription. This can create a significant burden on elderly persons having several different prescriptions, who may open several vials to locate a desired prescription. A similar problem is encountered in the pharmacy, where a pharmacist must repeatedly remove a large number of safety caps to reverify that the prescription has been properly filled, prior to dispensing to the customer.

The perimeter of the common previous cap design is ridged to permit more secure gripping during cap removal. However, some persons have difficulty removing these safety caps, particularly elderly persons and others who lack hand strength. The ridges typically do not offer adequate gripping to assist in cap removal.

SUMMARY OF THE INVENTION

In view of the difficulties and drawbacks encountered with previous safety caps, there is therefore a need for a safety cap that permits easy opening for persons who may lack hand strength.

There is also a need for a safety cap that permits reverification of a prescription without repeated removal of the cap from the vial.

There is also a need for a safety cap having indicia that are not lithographically applied.

There is also a need for a safety cap having indicia that will not chafe or irritate hands after repeated opening of a vial.

These needs and others are satisfied by the sealable container of the present invention in which a cap is provided having a circumferential outer skirt for engaging a container and having a circumferential resilient depending inner member spaced from and extending substantially parallel to the outer skirt. The cap is substantially light-transmissive over at least a portion of the visible spectrum, so as to permit viewing through the cap. A container is provided having a rigid side wall for engagement with the resilient inner member of the cap internally thereof. The side wall has an end fitting within the resilient inner member of said cap and spaced radially inwardly therefrom when the cap is secured to the container. The side wall is tapered. Structures are provided on the container remotely from the end of the rigid wall. Cooperative structures are provided on the cap for preventing the cap from being removed from the container without depression of the cap on the container and rotation of the cap on the container.

As will be appreciated, the invention is capable of other and different embodiments, and its several details are capable of modifications in various respects, all without departing from the invention. Accordingly, the drawings and description are to be regarded as illustrative in nature and not restrictive.

BRIEF DESCRIPTION OF THE DRAWINGS

The embodiments of the invention will now be described by way of example only, with reference to the accompanying figures wherein the members bear like reference numerals and wherein.

DETAILED DESCRIPTION OF THE INVENTION

Figure 1:
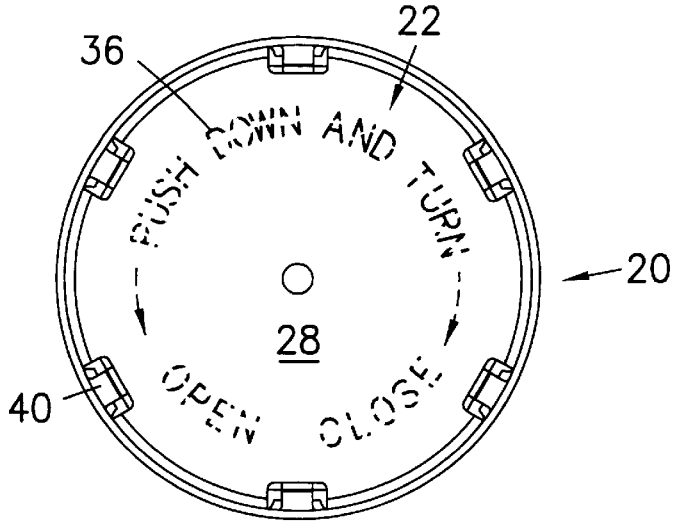
FIG. 1 is a top view of the safety cap as according to the present invention.
Figure 2:
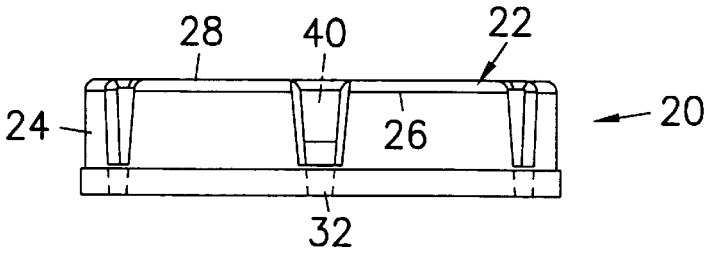
FIG. 2 is a side view of the safety cap as according to the present invention.
Figure 3:
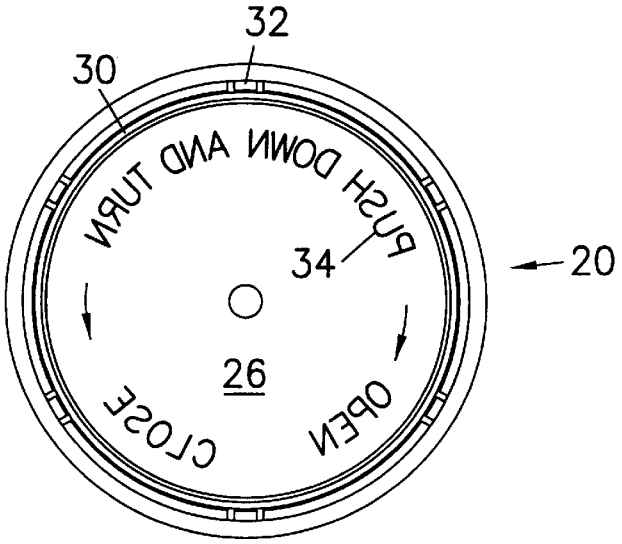
FIG. 3 is a bottom view of the safety cap as according to the present invention.
Figure 4:
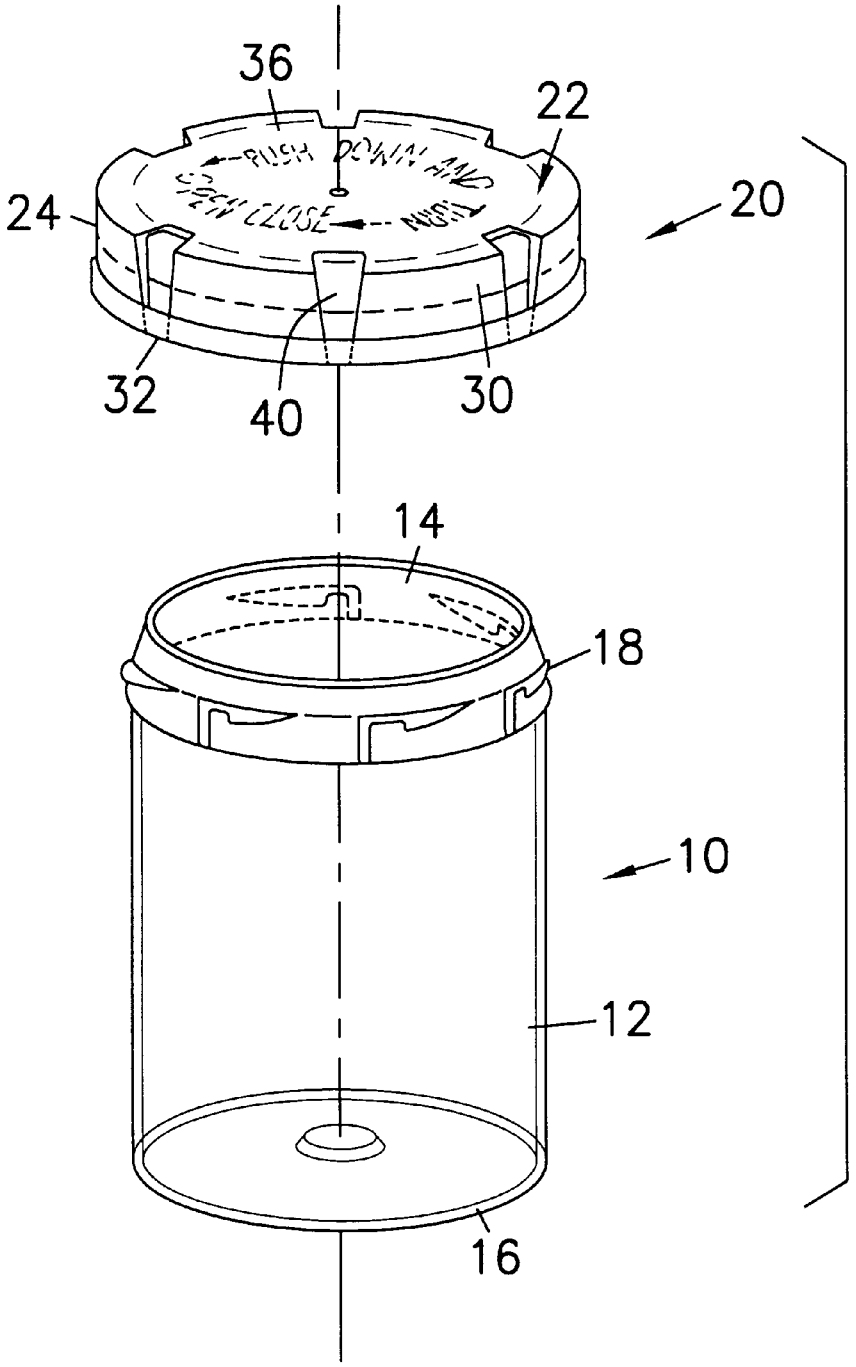
FIG. 4 is an exploded oblique view of the safety cap with vial as according to the present invention.

Turning now to the figures, a safety cap is disclosed for sealing the open end of a container, preferably a vial 10. As shown in FIG. 4, the vial 10 has a rigid, substantially cylindrical side wall 12 with an open end 14 for receiving e.g. prescription medicine and the like, and a closed end or bottom 16. The cylindrical wall 12 preferably includes a plurality of lugs 18 positioned substantially proximate to the open end 14, along the perimeter of the vial 10. In the preferred embodiment, the vial 10 is formed of a moldable polymer such as polypropylene, preferably tinted amber. The present vial conforms to the requirements of light-transmissivity for pharmaceutical containers specified by the United States Pharmacopeia Convention, Inc., 12601 Twinbrook Parkway, Rockville, Md. 20852. These requirements, published in USP 23 <661>, are shown in Table 1 below:

TABLE 1

| Maximum Percentage of Light Transmission at Any Wavelength Between 290 nm and 450 nm | |
|---|---|
| Nominal Size (in mL) | Closure-sealed Containers |
| 1 | 25 |
| 2 | 20 |
| 5 | 15 |
| 10 | 13 |
| 20 | 12 |
| 50 | 10 |

(Note - Any container of a size intermediate to those listed above exhibits a transmission not greater than that of the next larger size container listed in the table. For containers larger than 50 mL, the limits of 50 mL apply.)

In the illustrated embodiment, the outwardly-formed radial surface of the side wall 12 near the open end 14 is tapered. A safety cap 20 is provided for sealing the open end 14 of the vial 20. The cap 20 includes a substantially flat top portion 22 formed integrally with a substantially cylindrical side portion, i.e. a circumferential outer skirt 24. The cap 20 is light-transmissive over a portion of the visible spectrum. In this way, the contents of the vial 10 are visible through the cap 20 in order to allow reverification of a prescription by a pharmacist or patient, without requiring repeated removal of the cap 20 from the vial 10.

In order to conform with the various standard requirements, the cap 20 is also formed of polypropylene and tinted, preferably amber, to conform with the light-transmissivity standards specified in USP 23 <661> while sufficiently transmissive in the remainder of the visible spectrum to permit a user to view and reverify the contents of the vial 10. Polypropylene tends to be somewhat cloudy, and needs to undergo a standard clarification process in order to become sufficiently transmissive so as to permit reverification.

The majority of previous safety cap designs include a separate inner liner which is retained inside the cap to seal against the open end of the vial when closed. However, such a combination cap includes multiple surface profiles which would prohibit viewing and reverification even if the components were formed of a transmissive material. Thus, the present cap 20 is formed as a one-piece cap assembly, and the various cap elements are formed integrally with the cap 20. In this way, the vial contents can be seen through the present cap 20.

In the preferred embodiment, the top portion 22 includes an internal surface 26, which during engagement is substantially adjacent to the open end 14 of the vial 10. The top portion 22 also includes an external surface 28 opposite to the internal surface 26. An inner seal member is provided in the form of a circumferential resilient depending inner member 30 which is formed integrally with the top portion 22 and extends perpendicularly from the internal surface 26.

The resilient inner member 30 is spaced from and extends substantially parallel to the outer skirt 24. During engagement of the cap 20 and the vial 10, the side wall 12 near the open end 14 of the vial 10 fits within the resilient inner member 30, and is spaced radially inwardly therefrom when the cap 20 is secured to the vial 10. In this way, the inner depending member 30 makes sealing contact with the open end 14 of the vial 10.

A number of retaining structures 32 are formed integrally along the outer skirt 24 of the cap 20 which engage and cooperate with the lugs 18 in order to retain the cap 20 and vial 10 in mechanical engagement. The retaining structures 32 cooperate with the lugs 18 to prevent the cap 20 from being removed from the vial 10 without depressing the cap 20 on the vial 10 and subsequently rotating the cap 20 on the vial 10. A combination container and safety cap with operation similar in principle to that of the present invention is shown in U.S. Pat. No. 5,449,078, the disclosure of which is hereby incorporated by reference.

As the inner member 30 is near the side portion of the cap 20, a substantially unobstructed area is provided. Since only two flat optical planes are provided, at the internal and external surfaces 26, 28 of the top portion 22, the present invention permits direct unobstructed viewing and reverification of the vial contents. Also, in the preferred embodiment, the top portion 22 includes molded indicia 34 which are formed on the internal surface 26. These indicia 34 can be viewed as a transmitted image profile 36 as seen above the external surface 28. In the preferred embodiment, the indicia 34 are text or logos formed as a "mirror image" so as to permit a normally-reading light image 36 as viewed from the external surface 28. The indicia 34 can be featured either raised or depressed from the plane of the internal surface 26. In this way, the external surface 28 is kept flat and planar, which reduces chafing and irritation of hands upon repeated cap removal. Also, by molding the indicia 34 into the cap, lithographic printing costs are eliminated, resulting in considerable reduction in production costs.

As a further feature of the invention, the present cap 20 includes a plurality of slots 40. These slots 40 are formed as openings passing all the way through the outer skirt 24. The slots 40 thus provide a better gripping surface, which permits easy opening for persons who may lack hand strength. Each side of the slot 40 has a draft angle of five degrees in a direction parallel to the cylindrical axis of the outer skirt 24. Each side is tapered inwardly toward the center of the slot 40, so that the slot 40 has its greatest width toward the top [portion 22 and its narrowest width at the opposite side. The five degree taper additionally permits the cap 20 to be released from the mold during manufacture, in accordance with standard tool and die requirements. The edges of the slots 40 are radiused to avoid sharp, abrasive edges.

Figure 5:
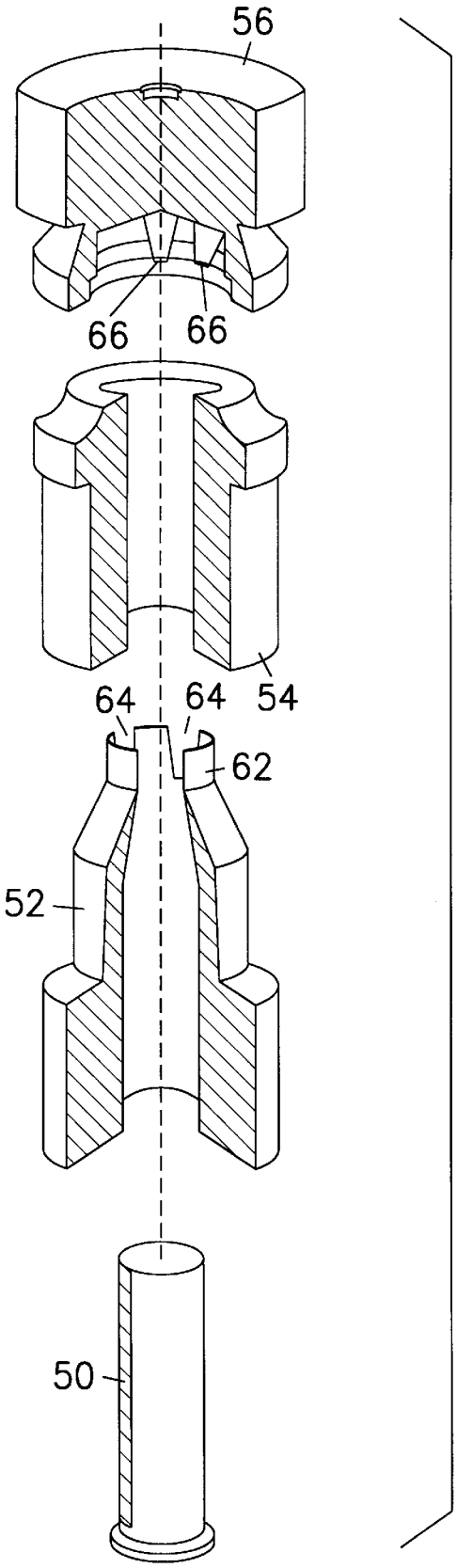
FIG. 5 is an exploded cutaway view showing the tooling used to make the cap of the presentinvention.
Figure 6A:
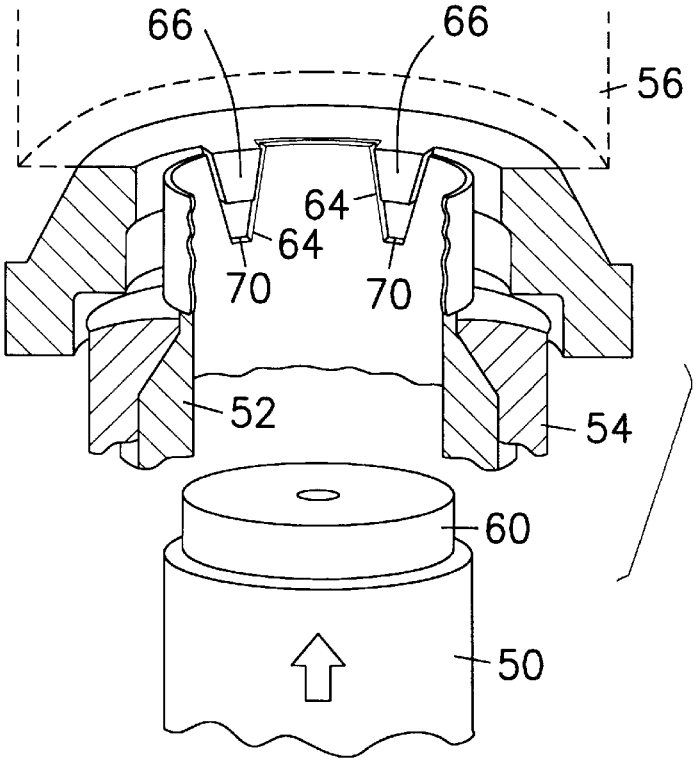
FIGS. 6A and 6B are oblique cutaway views showing the operation of the tool components used to make the cap of the present invention.
Figure 6B:
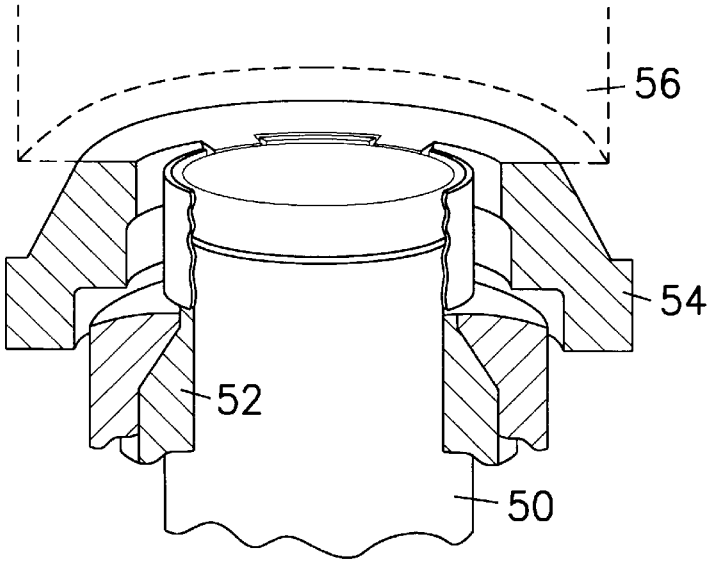

The slots 40 also permit a less complicated molding process for the cap during manufacture. Most previous caps are made with a collapsible core having many moving parts. Such core elements are expensive to fabricate, expensive to maintain, and slow during production. Thus, collapsible cores add considerably to the cost of manufacture. The tooling required for the present invention is shown in FIG. 5 and FIGS. 6A and 6B. When assembled, all the tool elements fit coaxially together along the same cylindrical axis. A central core element 50 is formed that resides coaxially within the outer core element 52 to form a solid core. A stripper ring 54 fits coaxially around the solid core. A cavity section 56 fits over the top of the stripper ring 54. During operation, the cavity 56 closes over the stripper ring 54 and plastic is injected into the mold. Afterwards, the cavity 56 comes away along the axial direction and the stripper 54 moves axially to remove the part from the mold sections.

As shown in FIGS. 6A and 6B, a taper 60 is formed on the central core member 50, a sleeve section 62 is formed on the outer core member 52. The space between the taper 60 and the sleeve 62 forms the resilient depending member 30. The space between the internal section 64 of the cavity 56 and the sleeve 62 forms the outer skirt 24 and top portion 22 of the cap 20. The sleeve 62 includes a plurality of notches 64. The cavity includes a plurality of respectively mating ribs 66, which fit within and are flush with the notches 64 when the cavity 56 engages the core. During molding, the ribs 66 define the slots 40 as void regions of the cap 20. A gap 70 is defined under the rib 66 which forms the lug 18 during molding.

After a molding cycle is ended, the finished cap 20 can be removed from the mold by the stripper ring 54, which pushes the part from the core. All the profile features (including the slots 40, the inner seal member 30 and the lugs 18) are molded along the same axial line-of-action of the tooling elements. By locating slots 40 above the lugs 18 in the tooling, the present cap 20 includes no profile features that are transverse to the line-of-action. Such transverse features are produced by the more expensive collapsible core elements, and are standard in the manufacture of previous safety caps. Thus, the axial line-of action of the present cap 20 uses a solid core that is a conventional elements, along with conventional stripper ring and cavity components. Since simpler tooling is required, the present cap 20 is less expensive to produce than previous safety caps. Additionally, the present design results in improved cycle times and better tool cooling than is possible with previous designs.

As described hereinabove, the present invention solves many problems associated with previous safety caps, and presents improved efficiency. However, it will be appreciated that various changes in the details, materials and arrangements of parts which have been herein described and illustrated in order to explain the nature of the invention may be made by those skilled in the art within the principle and scope of the invention as expressed in the appended claims.

We claim:

1. A sealable container comprising:

a cap having a circumferential outer skirt for engaging a container and having a circumferential resilient depending inner member spaced from and extending substantially parallel to said outer skirt, wherein the cap is substantially light-transmissive over at least a portion of the visible spectrum, so as to permit viewing through the cap;

a container having a rigid side wall for engagement with the resilient inner member of said cap internally thereof, said side wall having an end fitting within the resilient inner member of said cap and spaced radially inwardly therefrom when the cap is secured to the container, said side wall being tapered; and means disposed on said container remotely from said end of said rigid wall and cooperative means on said cap for preventing said cap from being removed from said container without depression of said cap on said container and rotation of said cap on said container;

wherein the container is a vial having a closed end and an open end, and wherein the side wall is substantially cylindrical, wherein the means disposed on said container is at least one lug on the cylindrical wall substantially proximate to the open end; and wherein the cap comprises a substantially flat top portion formed integrally with said circumferential outer skirt, wherein said circumferential resilient depending inner member is formed integrally with said top portion and extends therefrom; and wherein said cooperative means comprises at least one retaining structure formed on the outer skirt for cooperating with the lug to retain the cap in engagement with the vial; and wherein the top portion includes an internal surface substantially adjacent to the open end of the vial, and wherein the top portion includes molded indicia formed on the internal surface, which can be viewed from an external surface of the top portion.

2. The sealable container of claim 1 wherein the indicia are reverse-molded text formed as a mirror image to permit normal reading as viewed from the external surface.

3. The sealable container of claim 1 wherein the cap and container conform to the light-transmissivity standards specified in USP 23 <661> while being sufficiently transmissive in the remainder of the visible spectrum to permit a user to view the vial's contents.

4. A cap for sealing the open end of a vial, wherein the cap is substantially light-transmissive over at least a portion of the visible spectrum, so as to permit viewing through the cap, wherein the cap comprises:

a substantially flat top portion including an internal surface having molded indicia formed thereon, said molded indicia can be viewed from an external surface of the top portion;

an inner seal member formed integrally on the top portion to seal the open end of a vial upon engagement;

a substantially cylindrical side portion having at least one retaining structure formed thereon for retaining the cap in engagement with the vial.

5. The cap of claim 4 wherein the indicia are reverse-molded text formed as a mirror image to permit normal reading as viewed from the external surface.

6. The cap of claim 4 wherein the side portion the cap includes a plurality of slots extending through the sidewall.

7. The cap of claim 4 wherein the cap conforms to the light-transmissivity standards specified in USP 23 <661> while being sufficiently transmissive in the remainder of the visible spectrum to permit a user to view the vial's contents.

* * * * *